US010690401B2

(12) United States Patent
Yang et al.

(10) Patent No.: US 10,690,401 B2
(45) Date of Patent: Jun. 23, 2020

(54) REFRIGERATOR

(71) Applicant: LG ELECTRONICS INC., Seoul (KR)

(72) Inventors: Changwoan Yang, Seoul (KR); Yoomin Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/308,682

(22) PCT Filed: Jun. 9, 2017

(86) PCT No.: PCT/KR2017/006049
§ 371 (c)(1),
(2) Date: Dec. 10, 2018

(87) PCT Pub. No.: WO2017/213471
PCT Pub. Date: Dec. 14, 2017

(65) Prior Publication Data

US 2019/0162466 A1 May 30, 2019

(30) Foreign Application Priority Data

Jun. 10, 2016 (KR) ..... 10-2016-0072784

(51) Int. Cl.
*F25D 25/02* (2006.01)
*A47B 96/04* (2006.01)
(Continued)

(52) U.S. Cl.
CPC ..... *F25D 25/025* (2013.01); *A47B 77/04* (2013.01); *A47B 88/48* (2017.01); *F25D 23/067* (2013.01); *F25D 25/04* (2013.01)

(58) Field of Classification Search
CPC ..... F25D 25/025; F25D 23/021; A47B 88/48; A47B 77/04
See application file for complete search history.

(56) References Cited

U.S. PATENT DOCUMENTS 2,486,564 A * 11/1949 Kamin ..... F24C 15/162 126/41 E
2,819,141 A * 1/1958 Myer ..... A47J 47/005 312/303
(Continued)

FOREIGN PATENT DOCUMENTS

KR 10-0564412 3/2006
KR 10-2006-0101038 9/2006
(Continued)

*Primary Examiner* — Kimberley S Wright
(74) *Attorney, Agent, or Firm* — Fish & Richardson P.C.

(57) ABSTRACT

The present invention relates to a refrigerator comprising: a cabinet having a storage space formed therein; a door installed in the cabinet to open or close the storage space; a plurality of drawers disposed inside the storage space and arranged vertically; an elevating drawer disposed in a lower position than the other drawers among the plurality of drawers; a rail assembly disposed on the both sides of the elevating drawer to allow the elevating drawer to slide in or slide out from the storage space; and an elevating assembly which is rotatably connected to each of the rail assembly and the elevating drawer, and allows the elevating drawer to be moved up and down by the rotation of the elevating assembly in a state in which the rail assembly has been extracted.

17 Claims, 13 Drawing Sheets

(51) Int. Cl.

| | |
|---|---|
| ***A47B 77/04*** | (2006.01) |
| ***A47B 88/48*** | (2017.01) |
| *F25D 25/04* | (2006.01) |
| *F25D 23/06* | (2006.01) |

(56) References Cited

U.S. PATENT DOCUMENTS 2,953,287 A * 9/1960 Werner ..... B60R 5/04 224/496
3,524,692 A * 8/1970 Preston ..... B65F 1/1436 312/322
7,232,196 B2 * 6/2007 Kwon ..... A47B 46/005 312/402
8,152,255 B2 * 4/2012 Nam ..... F25D 25/025 312/270.3
8,376,482 B2 * 2/2013 An ..... F25D 25/02 312/408
8,733,862 B1 * 5/2014 Armstrong ..... F24C 15/16 126/337 A
8,827,390 B2 * 9/2014 Wehner ..... F25D 23/028 312/405.1
8,936,332 B2 * 1/2015 Park ..... F25D 11/00 312/404
9,022,496 B2 * 5/2015 Armstrong ..... F24C 15/16 312/319.3
9,170,043 B2 * 10/2015 Choo ..... F25D 23/00
9,243,839 B2 * 1/2016 Kim ..... F25D 25/02
9,464,841 B2 * 10/2016 Choo ..... F25D 23/00
2005/0073225 A1 * 4/2005 Kwon ..... A47B 46/005 312/402
2006/0013676 A1 * 1/2006 Oh ..... A47B 51/00 414/288
2006/0042303 A1 * 3/2006 Oh ..... A47B 51/00 62/407
2006/0103273 A1 * 5/2006 Lee ..... A47B 51/00 312/236
2014/0125212 A1 * 5/2014 Choo ..... F25D 23/00 312/405.1
2016/0010915 A1 * 1/2016 Choo ..... F25D 23/00 312/404
2016/0146532 A1 * 5/2016 Choo ..... F25D 25/024 312/408
2019/0293345 A1 * 9/2019 Kim ..... E05C 7/06

FOREIGN PATENT DOCUMENTS

KR 10-2011-0080874 7/2011
KR 10-2014-0057885 5/2014
KR 10-1622231 5/2016

* cited by examiner

REFRIGERATOR

CROSS-REFERENCE TO RELATED APPLICATIONS

This application is a National Stage application under 35 U.S.C. § 371 of International Application No. PCT/KR2017/006049, filed on Jun. 9, 2017, which claims the benefit of Korean Application No. 10-2016-0072784, filed on Jun. 10, 2016. The disclosures of the prior applications are incorporated by reference in their entirety.

TECHNICAL FIELD

The present invention relates to a refrigerator.

BACKGROUND ART

In general, a refrigerator is a home appliance that can keep food at low temperature in a storage space therein sealed by doors and is configured to be able to keep food in an optimal state by cooling the inside of the storage space using cold air that is produced through heat exchange with a refrigerant circulating through a cooling cycle.

Refrigerators are being increased in size and given various functions in accordance with variations of food culture and preferences of users and refrigerators having various structures and convenience devices for convenience for users and freshness of stored food have been released.

In general, drawers that can be drawn in and out can be provided in a refrigerator. The food that requires separate storage such as vegetables and fruits can be stored in the drawers and the insides of the drawers can be opened and close by a user drawing in and out the drawers.

When a user is disposed at the lower end in the space of the refrigerator, a user has to squat or bend over to put food into the drawer and it is also difficult to draw in and out the drawer.

In order to solve this problem, a drawer lifting device of a refrigerator has been disclosed in Korean Patent No. 10-0564412.

However, the drawer lifting device of a refrigerator of the related art is drawn in and out with a door sealing the inside of the refrigerator, so the entire size is large, and accordingly, large force is required to operate the device.

Further, the entire space sealed by the door is opened and close, so it is inefficient in terms of keeping cold air inside and it is also inconvenient to use.

Further, the structure for drawing in and out and moving up and down a drawer is complicated and a space for installed a separate configuration is required, so the entire storage space may be reduced.

DISCLOSURE

Technical Problem

An object of the present invention is to provide a refrigerator that can improve a keeping ability and convenience for a user because a drawer that can be drawn in and out of the refrigerator can be moved up and down.

Another object of an embodiment of the present invention is to provide a refrigerator that can improve stability and convenience in use because a drawer can be maintained in moving-up and moving-down states after drawn out.

Technical Solution

A refrigerator according to an embodiment of the present invention includes: a cabinet having a storage space; doors mounted on the cabinet to open and close the storage space; a plurality of drawers vertically arranged in the storage space; a lifting drawer disposed under the other drawers of the plurality of drawers; rail assemblies disposed at both sides of the lifting drawer and enabling the lifting drawer to slide into and out of the storage space; and lifting assemblies rotatably coupled to the rail assemblies and the lifting drawer such that the lifting drawer is rotated upward and downward with the rail assemblies drawn out.

The lifting assemblies each may include: a mounting plate fixed to the rail assemblies; a supporting member coupled to both left and right sides of the lifting drawer; a first link having both ends rotatably connected to a side of the mounting plate and the supporting member; a second link disposed in parallel with and behind the first link and having both ends connected to a side of the mounting plate and the supporting member; and an elastic member having both ends connected to the supporting member and the second link and providing elasticity by being stretched by rotation of the second link.

The rail assemblies may guide the lifting drawer that is drawn out to a position not interfering with a shelf disposed over the lifting drawer when the lifting drawer is rotated upward.

The lifting assemblies may rotate the lifting drawer in front of the drawers disposed over the lifting drawer when the lifting drawer is moved up.

The second link may be rotatably disposed behind the center of gravity of the lifting drawer such that the front end of the lifting drawer is tilted down after the lifting drawer is moved up.

Supporting member mounting portions may be recessed inward at the lower ends of both sides of the lifting drawer to accommodate the supporting members.

A seating portion protruding outward may be formed on the supporting member mounting portion and a supporting portion supporting and retaining the seating portion may be formed on the supporting member.

The first link and the second link may have the same length and are disposed in parallel with each other, and the first link may be rotated at a position higher than the second link.

The mounting plate may have: a first link connecting portion to which the upper end of the first link is rotatably coupled; and a second link connecting portion that extends downward further than the first link connecting portion at a side spaced part from the first link connecting portion and to which the upper end of the second link is rotatably coupled.

A first stopper and a second stopper that restrict rotation of the first link and the second link by coming in contact with the outer sides of the first link and the second link when the lifting drawer is positioned at the lowest position may be formed at the first link connecting portion and the second link connecting portion.

A third stopper that restricts rotation of the second link by coming in contact with the outer side of the second link when the lifting drawer is positioned at the highest position may be formed at the second link connecting portion.

An elastic member fixing portion fixing the lower end of the elastic member and a third stopper extending from the elastic member fixing portion and restraining rotation of the second link by coming in contact with the lower end of the rail assembly when the lifting drawer is positioned at the highest position may be formed at the second link.

Elastic member mounting portions for fixing the upper end of the elastic member may be formed rearward and upward from a rotary shaft of the second link, at the mounting plate.

The elastic member may have the smallest length when the second link comes in contact with the second stopper and the third stopper, and may be stretched and may have the largest length when the second link is rotated at the middle point between the second stopper and the third stopper.

The first link may be rotated across an extension line of the second link when the lifting drawer is tilted at the highest position.

Advantageous Effects

It is possible to expect the following effects from the refrigerator according to an embodiment of the present invention.

The refrigerator according to an embodiment is configured such that a lifting drawer can be rotated and moved up without interference with upper drawers after drawn out forward by the rail assemblies. Accordingly, a user can more easily put food into the lower lifting drawer after moving up the lifting drawer.

Further, since the lifting assemblies for moving up and down the lifting drawer connecting the rail assemblies and the lifting drawer through a simple structure, a compact configuration is possible and the volume of the lifting drawer can be maximized.

Further, since the structure of the lifting assemblies is simple, productivity is increased and the manufacturing cost can be reduced.

Further, the lifting assemblies have the elastic member, and force larger than the stretching force of the elastic member should be applied to adjust the height of the lifting drawer when the lifting drawer is positioned at the highest and lowest positions by selective stretching of the elastic member, so it is possible to prevent the lifting drawer from being unexpectedly moved up and down.

Further, when the lifting drawer is moved up over a predetermined height by operation of the lifting assemblies, the lifting drawer can be more easily moved up by elastic restoring force of the elastic member, so convenience and safety in use can be improved.

Further, the first link and the second link of the lifting assemblies can be rotated in parallel with each other and the lifting drawer can be tilted by the center of gravity of the lifting drawer when it finished being moved up. The first link is further rotated across the second link by tilting of the lifting drawer, and in this state, the lifting drawer is not moved down by its own weight, so convenience and safety in use can be improved.

MODE FOR INVENTION

Hereinafter, specific embodiments of the present invention are described in detail with reference to drawings. However, the present invention should not be construed as being limited to the embodiments describing the spirit of the present invention and, other retrogressive inventions or other embodiments included in the scope of the present invention may be proposed by adding, changing, and removing other components.

It should be noted that a bottom freezer type refrigerator having a freezer compartment under a refrigerator compartment and a French type door having a pair of doors at both sides are exemplified in embodiments of the present invention for the convenience of describing and understanding, but the present invention is not limited thereto and can be applied to all types of refrigerators configured such that drawers can be drawn in/out at the lower portion of the refrigerators.

Figure 1:
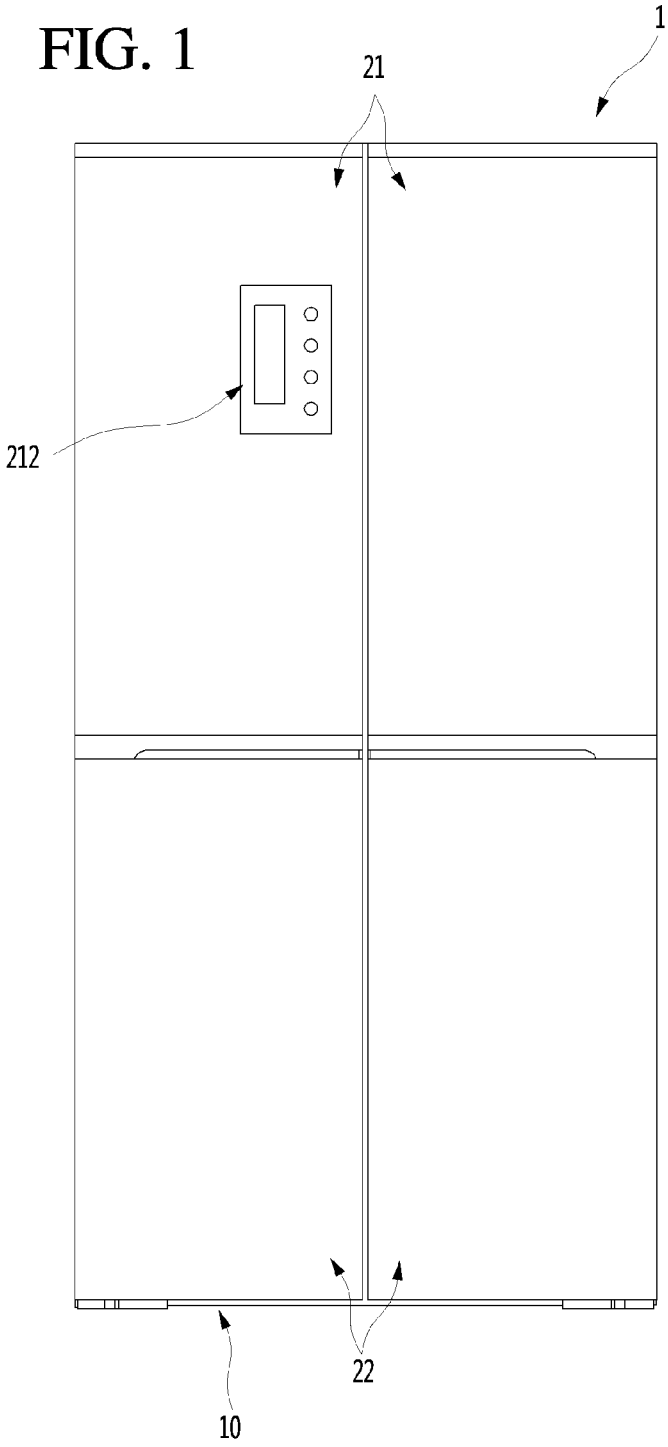
FIG. 1 is a front view of a refrigerator according to an embodiment of the present invention.
Figure 2:
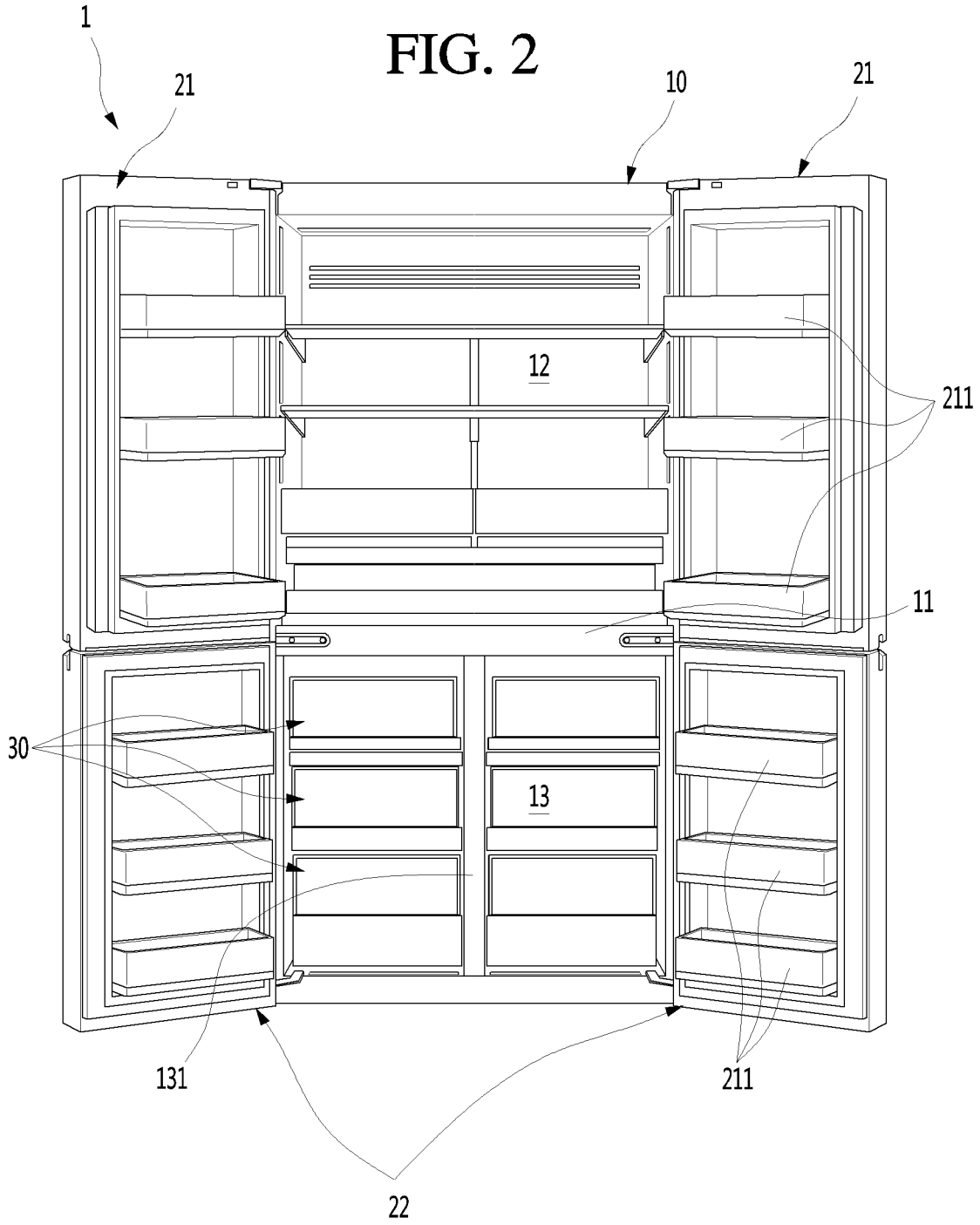
FIG. 2 is a view showing the refrigerator according to an embodiment of the present invention with doors open.

FIG. 1 is a front view of a refrigerator according to an embodiment of the present invention. FIG. 2 is a view showing the refrigerator according to an embodiment of the present invention with doors open.

As shown in the figures, a refrigerator 1 according to an embodiment of the present invention has an external shape formed by a cabinet 10 having storage spaces and doors opening/closing the storage spaces.

The inside of the cabinet 10 can be divided up and down by a barrier 11, so a refrigerator compartment 12 can be defined at the upper portion in the cabinet 10 and a freezer compartment 13 can be defined at the lower portion in the cabinet 10.

The doors may be composed of a refrigerator compartment door 21 and a freezer compartment door 22. The refrigerator compartment door 21 may be configured to open/close the open front of the refrigerator compartment 12 by rotating and the freezer compartment door 22 may be configured to open/close the open front of the freezer compartment 13 by rotating. The refrigerator compartment door 21 and the freezer compartment door 22 are each composed of a pair of left and right doors to seal the refrigerator compartment 12 and the freezer compartment 13.

A plurality of door baskets 211 and 221 may be mounted on the refrigerator compartment doors 21 and the freezer compartment doors 22 and may be configured not to interfere with storing members in the refrigerator when they are closed.

The refrigerator compartment doors 21 and the freezer compartment doors 22 are made of metal and form the entire shape when seen from the front, so the entire refrigerator 1 can have metallic texture. A display 212 that can be operated by a user to display the operation status of the refrigerator 1 may be disposed on the front side of a refrigerator compartment door 21. Though not shown in the figures, if necessary, an ice maker and an ice bank for making and storing ice may be disposed on the doors and a dispenser through which purified water or ice can be taken out may also be disposed on the doors. The refrigerator compartment doors 21 or the freezer compartment doors 22 may have a door space that can be opened/closed by a separate auxiliary door.

Various storing members such as a shelf, a drawer, or a basket may be disposed in the refrigerator compartment 12 and the freezer compartment 13. The storing members, if necessary, may be drawn in/out with the doors open, so the can store food by being drawn in/out.

In particular, a vertical barrier 131 dividing the freezer compartment 13 into left and right sections may be disposed in the freezer compartment 13 and a plurality of drawers may be disposed in the sections divided by the vertical barrier 131.

The drawers may be vertically arranged and can be drawn in/out by a user. The drawers may be configured not to be interfered with the door baskets 211 and 221 on the rear sides of the freezer compartment doors 22 when the freezer compartment doors 22 are closed.

Figure 3:
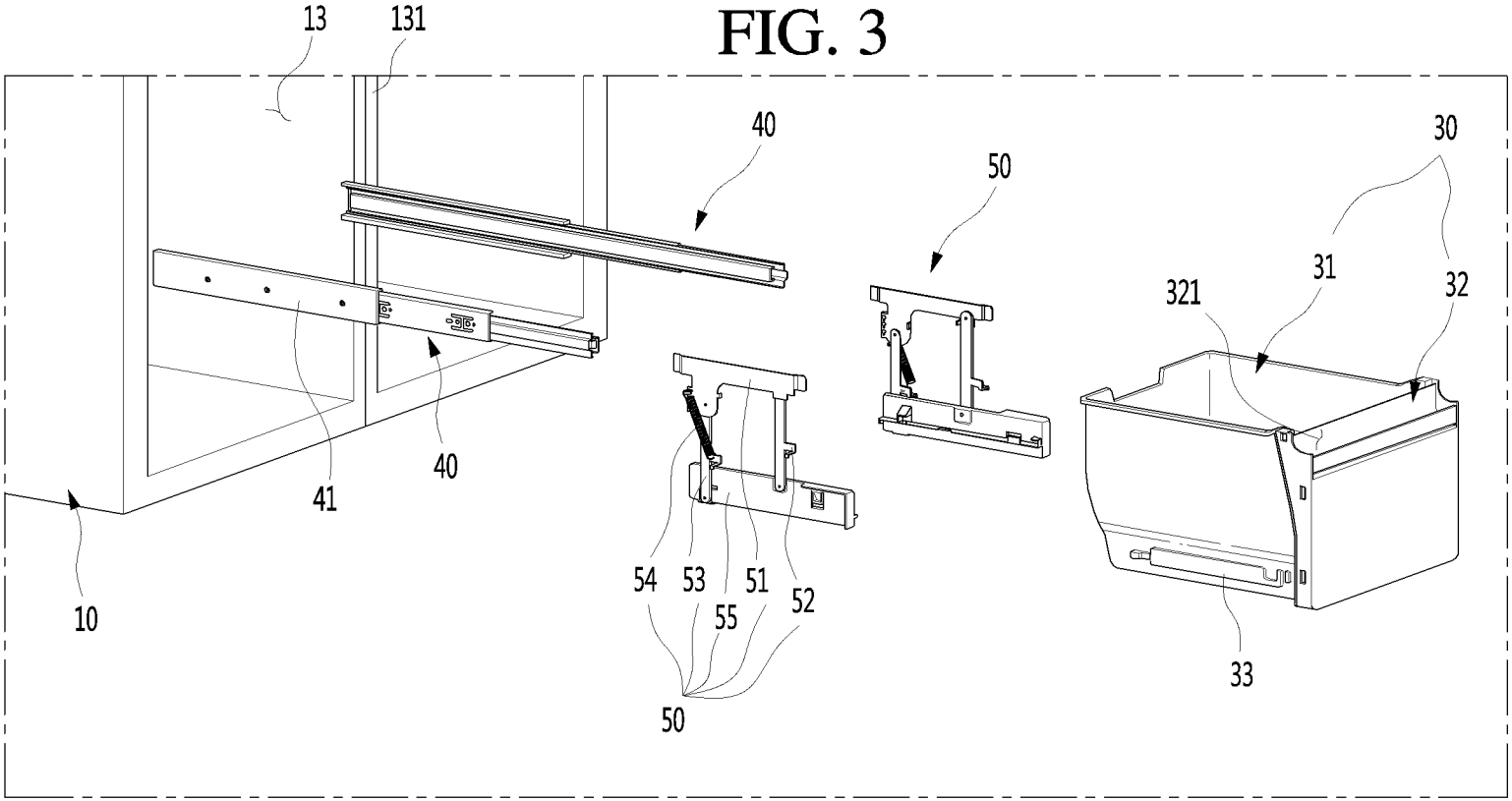
FIG. 3 is an exploded perspective view showing a separated lifting drawer according to an embodiment of the present invention.
Figure 4:
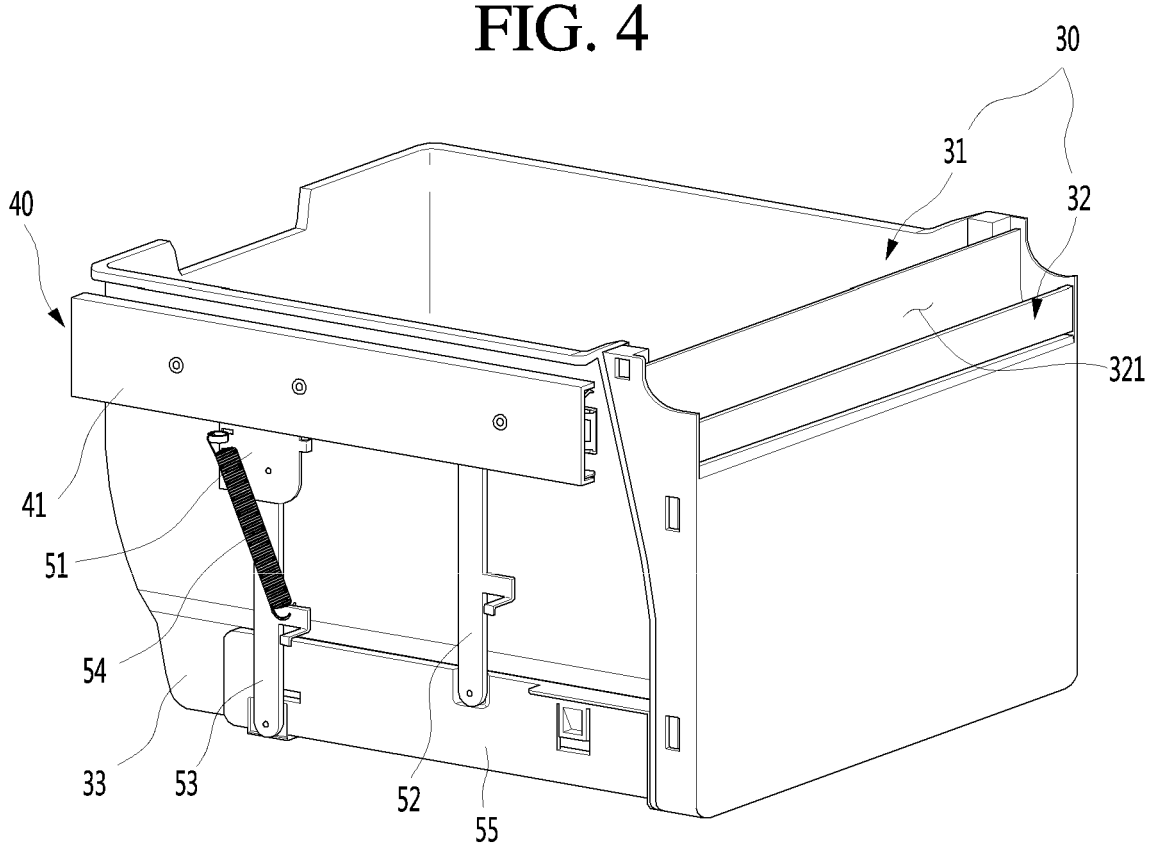
FIG. 4 is a perspective view showing a rail assembly and a lifting assembly mounted on the lifting drawer according to an embodiment of the present invention.
Figure 5:
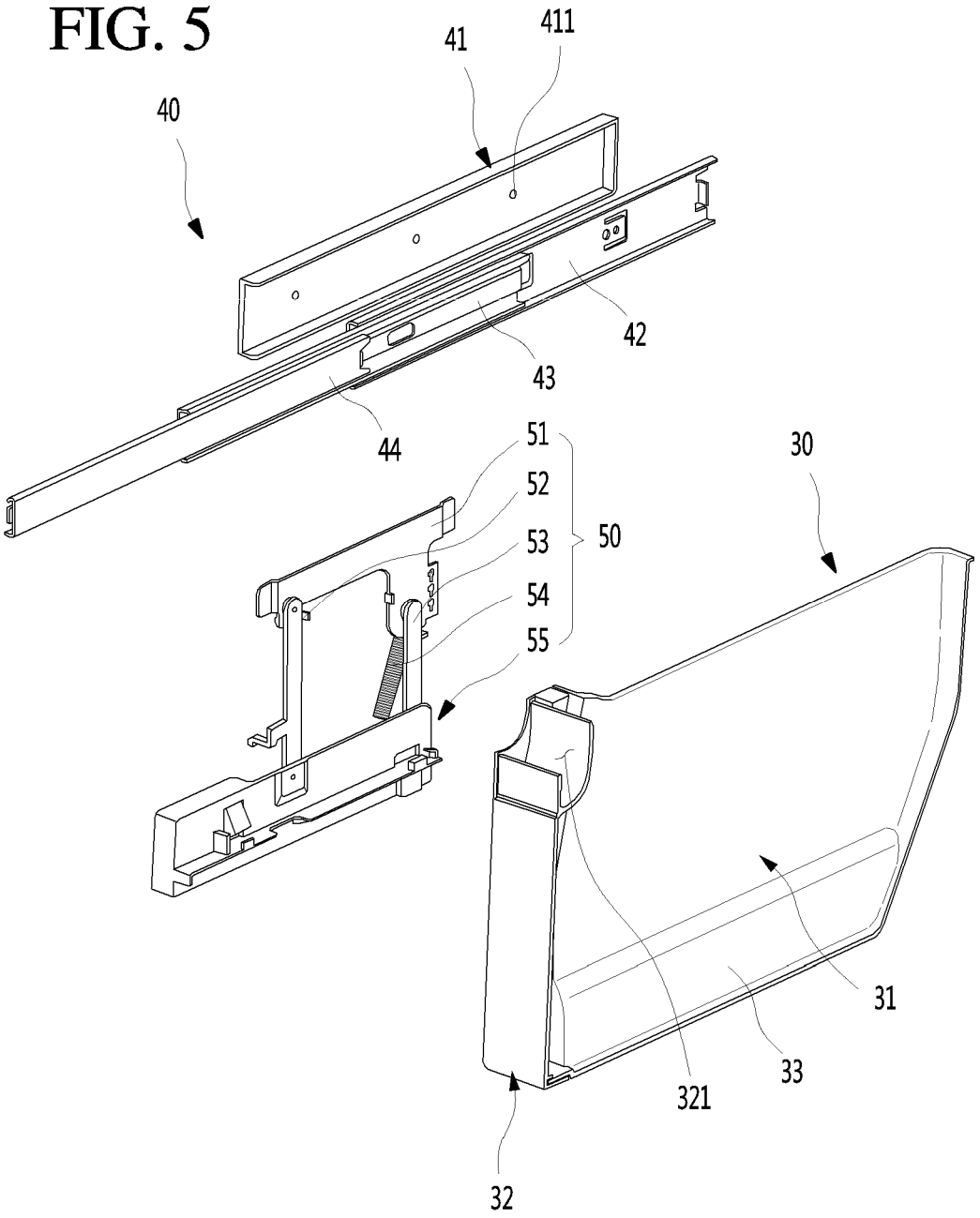
FIG. 5 is an exploded perspective view showing the coupling structure of the rail assembly, the lifting assembly, and the lifting drawer.
Figure 6:
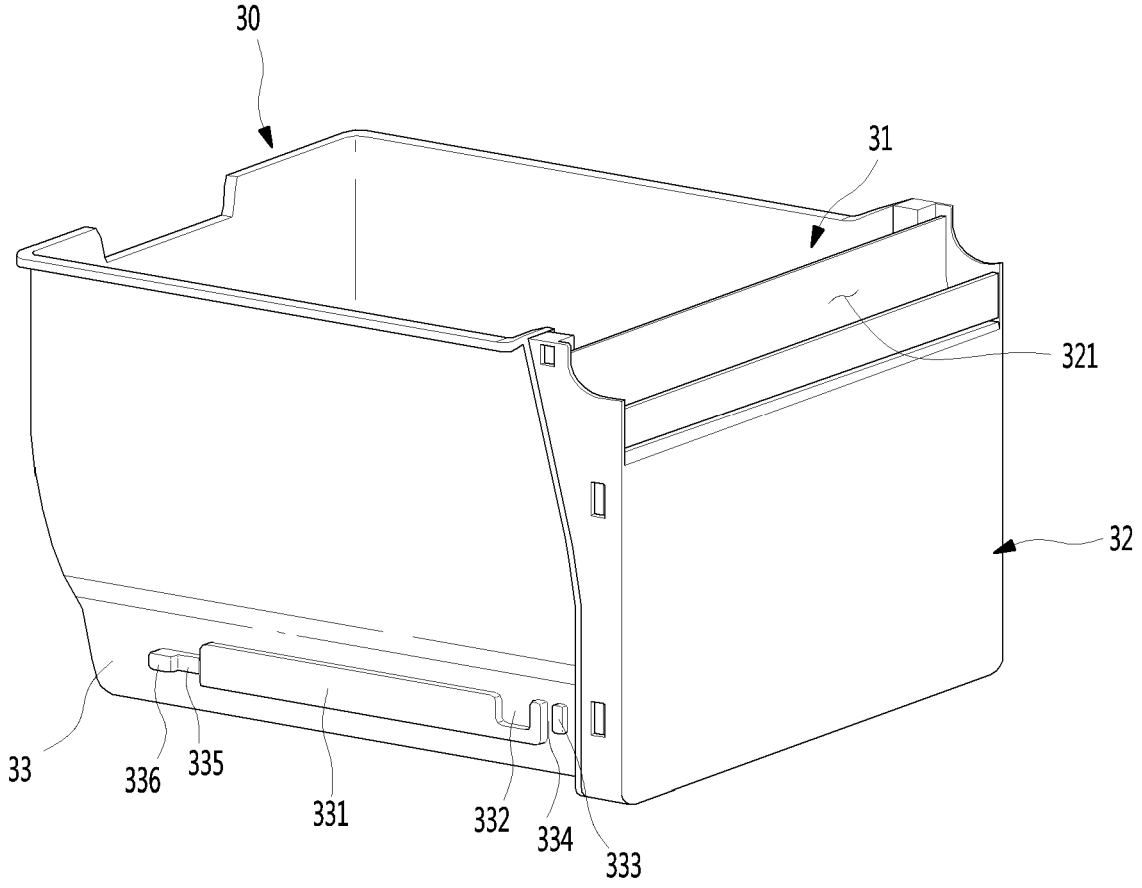
FIG. 6 is a perspective view of the lifting drawer.

FIG. 3 is an exploded perspective view showing a separated lifting drawer according to an embodiment of the present invention. FIG. 4 is a perspective view showing a rail assembly and a lifting assembly mounted on the lifting drawer according to an embodiment of the present invention. FIG. 5 is an exploded perspective view showing the coupling structure of the rail assembly, the lifting assembly, and the lifting drawer. FIG. 6 is a perspective view of the lifting drawer.

As shown in the figures, a plurality of drawers may be provided in the freezer compartment 13. A lifting drawer 30 that is the lowest one of the drawers can be moved up/down. Obviously, not only the lowest lifting drawer 30, but also the other drawers over the lifting drawer 30 may be moved up/down.

Rail assemblies 40 may be disposed at both sides of the lifting drawer 30. The rail assemblies 40 have a structure that can slide in/out in several steps and can be fixed on both sides in the refrigerator. The ends of the rail assemblies 40 can support the lifting drawer 30 at both sides of the lifting drawer 30. Accordingly, as the rail assemblies 40 slide in/out, the lifting drawer 30 can be drawn into/out of the refrigerator.

The rail assemblies 40 may be configured such that the lifting drawer 30 can be drawn out of the cabinet 10. The lifting drawer 30 is not interfered with other upper drawers when it is drawn out and moved up/down The rail assemblies 40 may be mounted inside rail cases 41 and the rail cases 41 are fixed to the walls in the refrigerator. The rail cases 41 may be made of plastic by injection molding and may cover and fix sides of the outermost rail assemblies 40. Rail fixing portions 411 protruding toward the rail assemblies 40 to fix the rail assemblies 40 may be formed on the inner sides of the rail cases 41.

The rail assemblies 40 can be drawn in/out in several steps and may be three-step rails that can stably support the lifting drawer 30. The rail assemblies 40 each may be composed of a first rail 42 fixed to the rail case 41, a second rail 43 mounted on the first rail 42 to be able to be drawn in/out, and a third rail 44 that is mounted on the second rail 43 to be able to be drawn in/out and on which the lifting assembly 50 is mounted. The first rail 42, second rail 43, and third rail 44 are supported by bearings, and the second rail 43 and the third rail 44 can be longitudinally smoothly drawn in/out. Obviously, the rail assemblies 40 may have not the three-step structure, but a two-step or four-step structure and rails having various structures that can draw in/out the lifting drawer 30 can be applied.

The lifting assemblies 50 for moving up/down the lifting drawer 30 may be coupled to the rail assemblies 40. The lifting assemblies 50 connect the rail assemblies 40 and the lifting drawer 30 so that the lifting drawer 30 is drawn in/out when the rail assemblies 40 slide. Further, the lifting assemblies 50 can move up/down the lifting assembly 30.

To this end, the lifting assemblies 50 each may include: a mounting plate 51 for coupling to the rail assemblies 40; a first link 52 connecting the mounting plate 51 and a supporting member 55; a second link 53 connecting the mounting plate 51 and the supporting member 55 at a predetermined distance from the first link 52; an elastic member 54 providing elasticity for restricting and forcing rotation of the first link 52 and the second link 53; and the supporting member 55 supporting both sides of the lifting drawer 30. The structure of the lifting assembly 50 will be described in detail below.

The lifting drawer 30 may include a drawer body 31 having an open top to provide a storing space for food and a front 32 forming the front portion of the lifting drawer 30. The drawer body 31 may be made of a transparent or translucent material so that the status of the food therein can be seen, or it may be made of plastic.

The front 32 is coupled to the front end of the drawer body 31, thereby forming the front external shape of the lifting drawer 30. A grip 321 for drawing in/out and moving up/down the lifting drawer 30 may be formed at the upper end of the front 32. The grip 321 may be recessed at the upper end of the front 32 in a shape that a user can put his/her hand therein to hold it.

The lifting drawer 30 is disposed between the rail assemblies 40 and the lower ends of both sides of the lifting drawer 30 are supported by the supporting members 55. To this end, supporting member mounting portions 33 may be formed at the lower portion of the lifting drawer 30.

The supporting member mounting portions 33 may be recessed inward at the lower ends of both sides of the lifting drawer 30. Further, they may extend from the front end to the rear end of the drawer body 31. That is, the sides of the lifting drawer 30 may be stepped and the supporting member mounting portions 33 may be formed at the lower ends of the stepped sides of the lifting drawer.

Mounts 331 longitudinally extending for coupling to the supporting members 55 may be formed at the supporting member mounting portions 33. The mounts 331 protrude from the supporting member mounting portions 33 and are supported on the lower ends by the supporting members 55, thereby providing a stable structure for moving up/down the lifting drawer 30.

A front vertical recession 332 in which a fourth stopper 532, which is a front vertical retainer, of the supporting member 55 is inserted is formed downward at the seating portion 331. The front vertical recession 332 may be formed in a shape corresponding to the shape of a front retainer rib 552*a*.

A front fixing protrusion 333 is formed ahead of the seating portion 331. The front fixing protrusion 333 may protrude at a predetermined distance from the front end of the seating portion 331. Accordingly, a front insertion portion 334 is formed between the front end of the seating portion 331 and the front fixing protrusion 333 and a front retainer 554 of the supporting member 55 can be inserted and fixed in the front insertion portion 334.

A rear vertical recession 335 that is deeper than the front vertical recession 332 may be formed at the rear portion of the seating portion 331. The rear vertical recession 335 may be formed in a corresponding shape at a corresponding position so that a rear retainer rib 55*b* of the supporting member 55 can be inserted therein.

A rear fixing protrusion 336 may be formed at the rear end of the seating portion 331. The rear fixing protrusion 336 extends rearward further from the rear end of the seating portion 331 and can be inserted into a rear retainer 555 of the supporting member mounting portion 33.

As described above, the lifting drawer 30 can be combined with the supporting members 55 seated in the supporting member mounting portions 33, so the lifting drawer 30 can be moved up/down by operation of the lifting assemblies 50.

Figure 7:
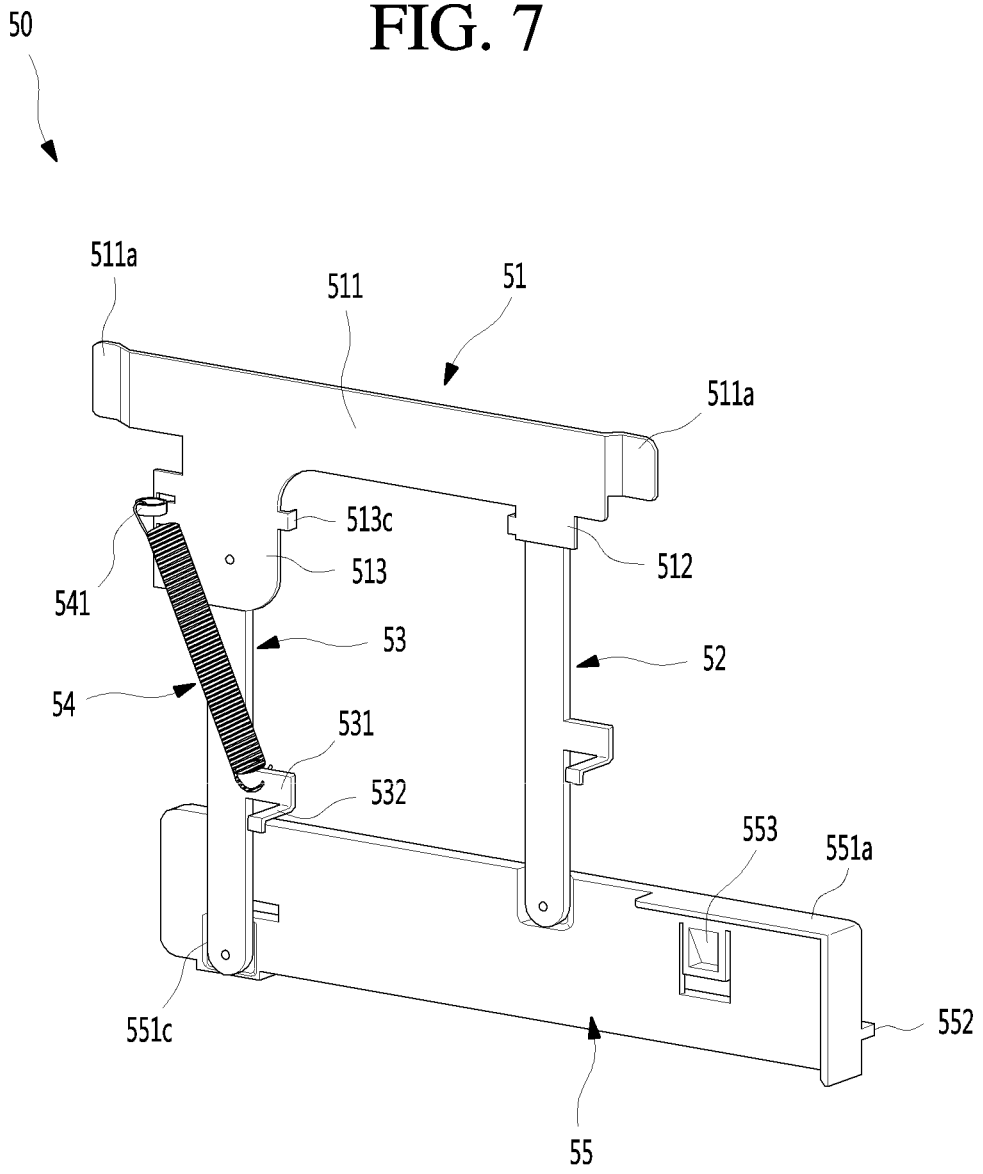
FIG. 7 is a perspective view of a lifting assembly.
Figure 8:
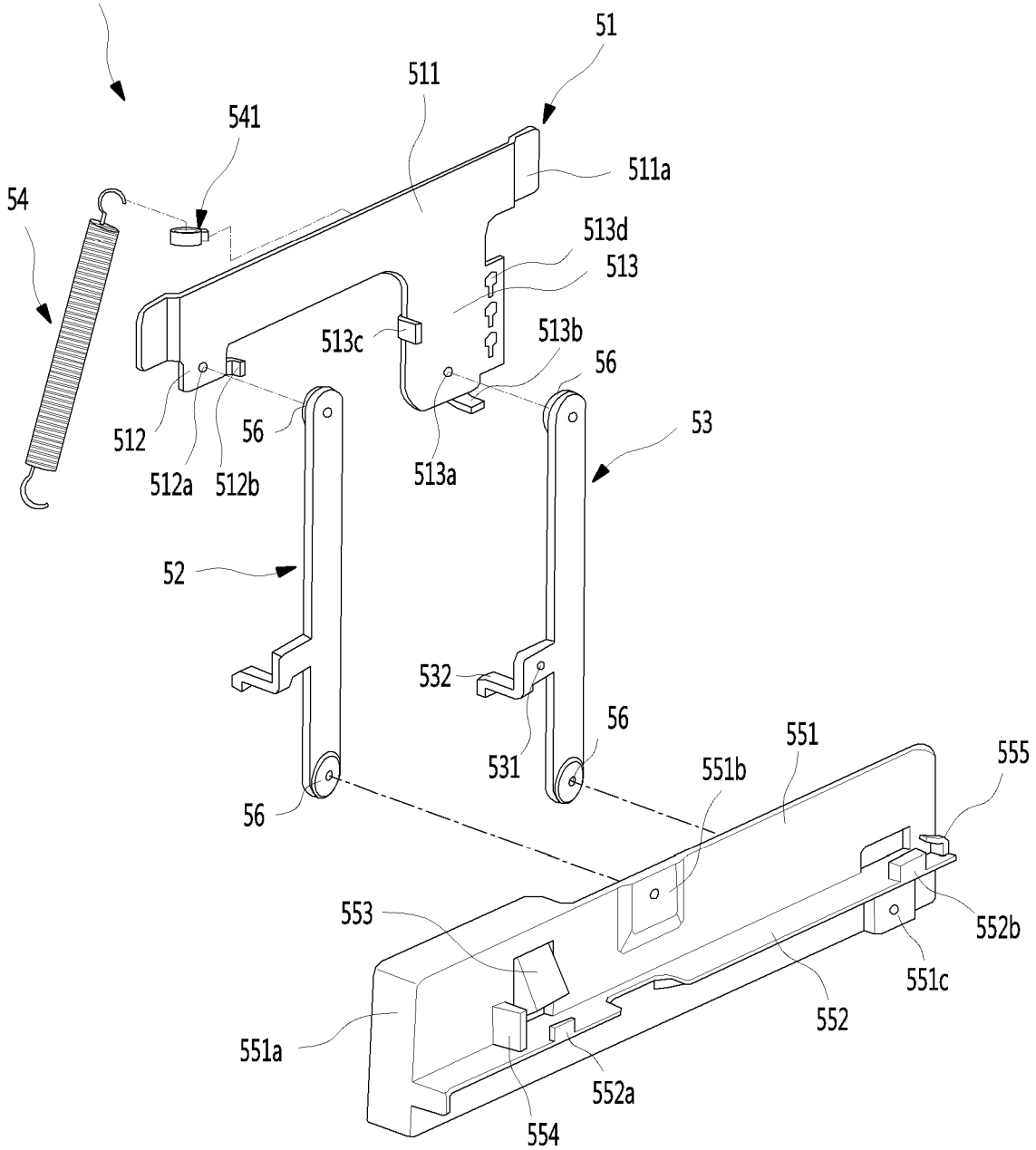
FIG. 8 is an exploded perspective view of the lifting assembly.

FIG. 7 is a perspective view of a lifting assembly. FIG. 8 is an exploded perspective view of the lifting assembly.

As shown in the figures, the lifting assembly 50 may include the mounting plate 51, a first link 52, a second link 53, an elastic member 54, and a supporting member 55.

The mounting plate 51 may be made of metal of plastic having high strength in a plate shape. The mounting plate 51 may have a rail fourth stopper 532, 511 mounted on the rail assembly 40, and a first link connecting portion 512 and a second link connecting portion 513 to which the first link 52 and the second link 53 are coupled.

The rail fourth stopper 532, 511 may be formed at the upper end of the mounting plate 51 and may extend in the longitudinal direction of the rail assembly 40. The rail fourth stopper 532, 511 may have a width corresponding to the up-down width of the third rail 44 and may have bending portions 511*a* at both ends.

The bending portions 511*a* are continuously bent from both ends of the rail fourth stopper 532, 511. The bending portions 511*a* may be fixed to the inner side of the third rail 44. The bending portions 511*a* may be in surface contact with the third rail 44, so the rail fourth stopper 532, 511 between the bending portions 511*a* may be spaced apart from a side of the third rail 44. The bending portions 511*a* may be fixed with the third rail 44 by welding, may be fastened by separate fasteners (not shown), or may be formed in a shape that can be combined with the third rail 44.

The first link mounting portion 512 may extend downward from the front end of the rail fourth stopper 532, 511. A first rotational hole 512*a* in which a rotary shaft of the first link 52 is inserted may be formed at the first link mounting portion 512. Accordingly, the upper end of the first link 52 may be rotatably coupled to the first link mounting portion 512.

A first stopper 512*b* may be formed at the rear end of the first link mounting portion 512. The first stopper 512*b* may be bent perpendicularly from an end of the first link mounting portion 512 to be able to support the first link 52 by coming in contact with the first link 52 with the lifting drawer 30 at the lowest position. That is, when the first link 52 is positioned toward the floor, the outer end of the first link 52 is in contact with the first stopper 512*b*, so the first link 52 is not rotated any more and the lifting drawer 30 can be maintained at the lowest position.

The second link mounting portion 513 may extend downward from the rail fourth stopper 532, 511 behind the first link mounting portion 512. A second rotational hole 513*a* in which a rotary shaft of the second link 53 is inserted may be formed at the second link mounting portion 513. Accordingly, the upper end of the second link 53 may be rotatably coupled to the second link mounting portion 513.

A second stopper 513*b* may be formed at the lower end of the second link mounting portion 513. The second stopper 513*b* may be bent perpendicularly from an end of the second link mounting portion 513 to be able to support the second link 53 by coming in contact with the second link 53 with the lifting drawer 30 at the lowest position. That is, when the second link 53 is positioned toward the floor, the outer end of the second link 53 is in contact with the second stopper 513*b*, so the second link 53 is not rotated any more and the lifting drawer 30 can be maintained at the lowest position.

As described above, when the lifting drawer 30 is positioned at the lowest position, that is, when the lifting drawer 30 is not lifted upward, the first link 52 and the second link 53 are supported by the first stopper 512*b* and the second stopper 513*b*, respectively, so the lifting drawer 30 can be stably maintained at the position.

A third stopper 513*c* may be formed at the front end of the second link mounting portion 513. The third stopper 513*c* may be bent perpendicularly in the same direction as the second stopper 513*b* and restricts rotation of the second link 53 by coming in contact with an end of the second link 53 when the lifting drawer 30 is lifted at the highest position.

Accordingly, the third stopper 513*b* may be formed higher than the second rotational hole 513*a*. Further, it can hold the lifting drawer 30 at a predetermined position by restricting rotation of the second link 53.

An elastic member mounting portion 513*d* may be formed at the second link mounting portion 513. The elastic member mounting portion 513*d* may be spaced apart rearward and upward from the second rotational hole 513*a* and fixes an end of the elastic member 54.

That is, the elastic member mounting portion 513*d* is formed like a hole at a predetermines positions from the second rotational hole 513*a* on an extension line of a middle point of rotation of the second link 53 between the second stopper 513*b* and the third stopper 513*c*.

A fixing member 541 may be mounted in the elastic member mounting portion 513*d*. An end of the elastic member 54 is fixed to the fixing member 541 and the fixing member 541 is inserted and fixed in the elastic member mounting portion 513*d*. The elastic member mounting portion 513*d* may be a plurality of holes formed at the second link mounting portion 513, so, if necessary, it may be possible to adjust the elasticity of the elastic member 54 by changing the mounting position of the fixing member 541. Obviously, the elastic member mounting portion 513*d* may be formed not in a hole shape, but in a protruding shape corresponding to the shape of the fixing member 541, integrally with the second link mounting portion 513.

The elastic member 54, which is a part that provides elasticity when the second link 53 is rotated, can be stretched when the second link 53 is rotated by up-down movement of the lifting drawer 30. Accordingly, when the lifting drawer 30 is moved up and down, rotation of the second link 53 is restricted not to be smooth, and when the lifting drawer 30 is rotated at a predetermined angle, the second link 53 can be smoothly rotated, so the lifting drawer 30 can be easily moved up and down.

The elastic member 54 may be a spring, that is, an extension spring and the upper end and the lower end of the elastic member 54 are formed in hook shapes so that the elastic member 54 can be mounted. That is, the upper end of the elastic member 54 can be inserted and fixed in the fixing member 541 and the lower end of the elastic member 54 can be fixed to the elastic member fixing portion 531 formed at the second link 53.

Accordingly, the elastic member 54 is connected to the mounting plate 51 and the second link 53 and can be rotated with the second link 53 when the lifting drawer 30 is moved up and down. The upper end that is the rotational axis of the elastic member 54 is spaced apart from the second hole 513*a* that is the rotational axis of the second link 53, so the elastic member 54 provides elasticity by stretching or restoring, depending on rotation of the second link 53.

The first link 52 and the second link 53 are rotatably mounted on the first link mounting portion 512 and the second link mounting portion 513, respectively. A rotary member 56 that enables smooth rotation by spacing the first link 52 and the first link mounting portion 512 is disposed between the first link 52 and the first link mounting portion 512 and is fitted on the rotary shaft of the first link 52. The rotary member 56 may be made of oil-impregnated engineering plastic, so it enables smooth rotation of the first link 52. The rotary member 56 may be disposed at all of the upper end and lower end of the first link 52 and the upper end and lower end of the second link 53.

The first link 52 and the second link 53 may be formed in plate shapes having predetermined lengths and may be formed in long bar shapes having a length larger than a width. The first link 52 and the second link 53 connect the mounting plate 51 and the supporting member 55 to each other and may have the same length to rotate together when the lifting drawer 30 is moved up and down. The first link 52 and the second link 53 may be formed in the same shape, so the manufacturing cost can be reduced by sharing parts.

An elastic member fixing portion 531 to which the lower end of the elastic member 54 is fixed may extend from a side of the second link 53. The elastic member fixing portion 531 may extend forward from an end of the second link 53 and has a hole in which an end of the elastic member 54 is inserted, so the elastic member 54 can be mounted and fixed.

The elastic member 54 may be disposed at an angle forward with both ends fixed to the fixing member 541 and the elastic member fixing portion 531. Further, it may be formed at a position where the elastic member 54 is not stretched when the lifting drawer 30 is positioned at the lowest position.

A fourth stopper 532 laterally bending may be further formed at an end of the elastic member fixing portion 531. The fourth stopper 532 restricts rotation of the second link 53 by coming in contact with the lower end of the rail assembly 40 when the lifting drawer 30 is moved up at the highest position. The second link 53 can more stably restrict lifting of the lifting drawer 30 by simultaneously coming in contact with the third stopper 513*c*.

Since the first link 52 has the same shape as the second link 53, portions having the same structures as the elastic member fixing portion 531 and the fourth stopper 532 are also formed at the first link, but these are formed only for sharing parts without another operation.

The lower ends of the first link 52 and the second link 53 are rotatably coupled to the supporting member 55. Accordingly, the supporting member 55 can be moved up and down by rotation of the first link 52 and the second link 53.

The supporting member 55 may have a supporting body 551 that faces the wall in the refrigerator and on which the first link 52 and the second link 53 are mounted, and a supporting portion 552 that protrudes inward toward the lifting drawer on a side of the supporting body 551.

The supporting body 551 is formed in a shape that can be accommodated in the supporting member mounting portion 33 and may be elongated in the front-rear direction. An edge 551*a* is formed at the front end and at a portion of the upper end of the supporting body 551, thereby sealing the space between the lifting drawer 30 and the wall in the refrigerator. Accordingly, the mounting structure of the first link 52 and the second link 53 can be sealed without being exposed to the outside by the first link 52 and the second link 53, so the external appearance and the safety are improved.

A first link coupling portion 551*b* to which the lower end of the first link 52 is rotatably coupled may be formed at the upper end of the supporting body 551. The first link coupling portion is recessed so that the lower end of the first link 52 and the rotary member 56 can be accommodated. A hole through which the rotary shaft of the first link 52 passes is formed at the first link coupling portion 551*b*.

A second link coupling portion 551*c* to which the lower end of the second link 53 is rotatably coupled may be formed at the lower end of rear portion of the supporting body 551. The second link coupling portion 551*c* is recessed so that the lower end of the second link 53 and the rotary member 56 can be accommodated. A hole through which the rotary shaft of the second link 53 passes is formed at the second link coupling portion 551*c*.

As described above, the first link 52 and the second link 53 have the same length, but they may be mounted at different heights on the mounting plate 51 and the supporting member 55. That is, the first link 52 may be positioned slightly higher than the second link 53. Accordingly, when the lifting drawer 30 is moved up and down, the first link 52 and the second link 53 cannot interfere with each other when they are rotated.

A supporting portion 552 extending toward a side of the lifting drawer 30 may be formed in the inner side of the supporting body 551. The supporting portion 552 is formed in a rib shape having a predetermined thickness and may extend from the front end to the rear end of the supporting body 551. The supporting portion 552 is formed at a position where it can support the seating portion 331 from behind when the supporting member 55 is mounted on the supporting member mounting portion 33, and may protrude have a width where the seating portion 331 is seated.

A front-half retaining rib 552*a* and a rear-half retaining rib 552*b* that extend upward are formed at the protruding end of the supporting portion 552. The front-half retaining rib 552*a* and the rear-half retaining rib 552*b* are formed at the front half portion and the rear half portion of the supporting portion 552, respectively, to be inserted in the front vertical recession 332 and the rear vertical recession 335 and to fix the supporting member 55 not to be separated from the lifting drawer 30.

A vertical retaining portion 553 is formed at the supporting body 551 corresponding to the front-half retaining rib 552*a*. The vertical retaining portion 553 is inserted in the front vertical recession 332 of the seating portion 331, whereby it can restrict up-down movement of the supporting member 55.

A front retaining portion 554 may be formed ahead of the front-half retaining rib 552*a*. The front retaining portion 554 vertically extends in a rib shape being in contact with both of the supporting body 551 and the seating portion 331 and is inserted in the front insertion portion 334 between the front fixing protrusion 333 and the seating portion 331, thereby being able to restrict front-rear movement of the supporting member 55.

A rear retaining portion 555 may be formed behind the rear-half retaining rib 552*b*, that is, at the rear end of the supporting portion 552. The rear retaining portion 555 may extend upward from the rear end of the supporting portion 552 and then extend forward at an angle or to be rounded so that the rear fixing protrusion 336 can be fitted therein.

By the internal structures of the supporting member 55 and the supporting member mounting portion 33, movement in all directions of the up-down, front-rear, and left-right directions of the supporting member 55 can be restricted and the lifting drawer 30 can be maintained in a stable combined state when it is moved up and down.

Figure 9:
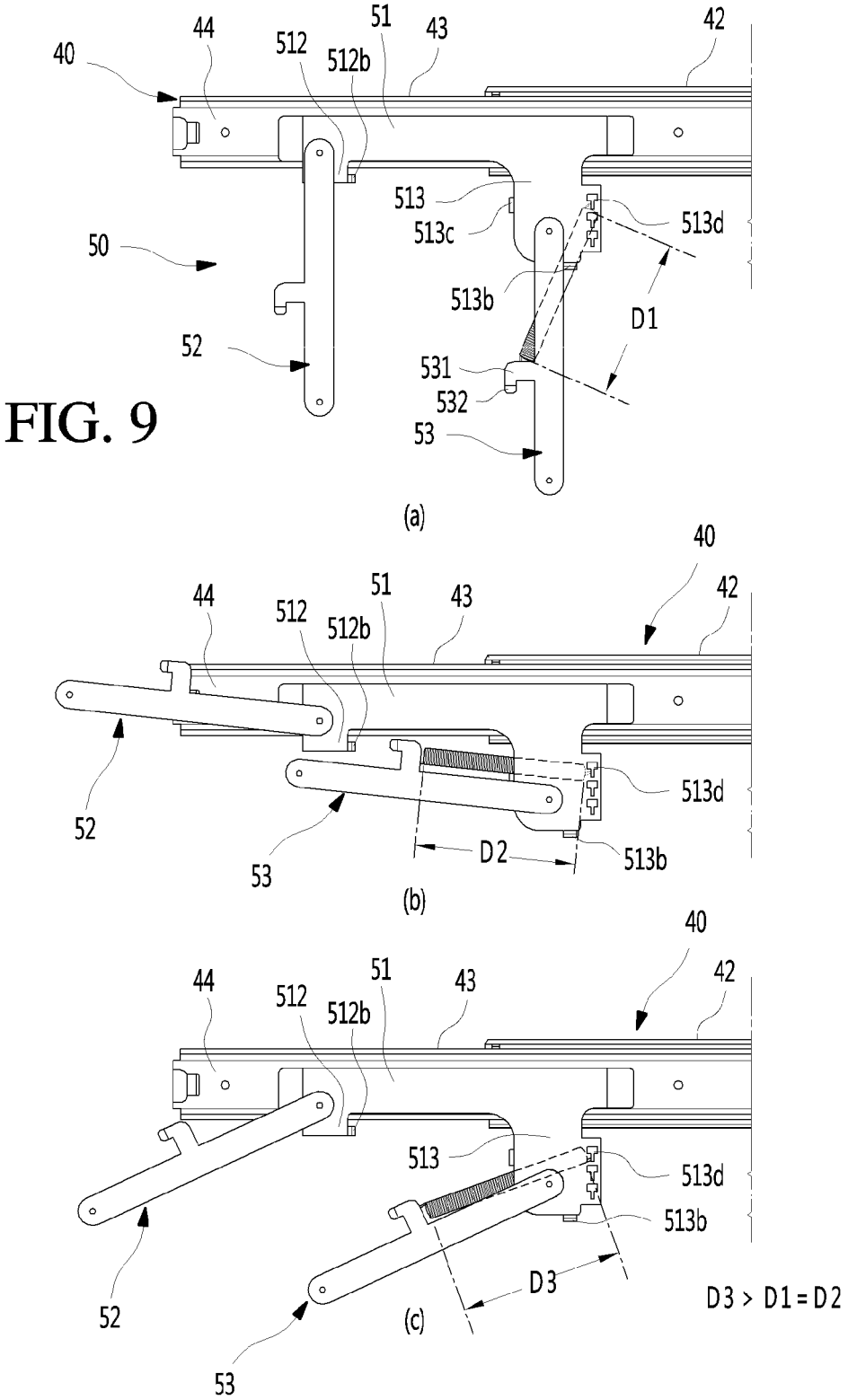
FIG. 9 is a view showing rotation of the lifting assembly.

FIG. 9 is a view showing rotation of the lifting assembly.

As shown in the figure, when the lifting drawer 30 is moved up and down, the first link 52 and the second link 53 are rotated, so the elastic member 54 can provide elasticity.

In detail, as shown in FIG. 9(*a*), when the lifting drawer 30 is not moved up and positioned at the lowest position, the first link 52 and the second link 53 are positioned to extend downward. The first link 52 and the second link 53 have structures that are supported by the first stopper 512*b* and the second stopper 513*b*, respectively. In this state, the elastic member 54 is not stretched or minimally stretched, and the length $D_1$ of the elastic member 54 is smallest.

Further, as shown in FIG. 9(*b*), when the lifting drawer 30 is moved up to the highest position, the first link 52 and the second link 53 are positioned to extend forward. The second link 53 is supported by the third stopper 513*c* and the fourth stopper 532 formed at the second link 53 is in contact with the mounting plate 51, so it is not rotated any more. Even in this state, the elastic member 54 is not stretched or minimally stretched, and the length $D_2$ of the elastic member 54 is the same as or close to the smallest length $D_1$.

Meanwhile, as shown in FIG. 9(*c*), while the lifting drawer 30 is moved up or down, the first link 52 and the second link 53 are rotated clockwise or counterclockwise. While the first link 52 and the second link 53 are rotated, the elastic member 54 is stretched and generates elastic restoring force.

In particular, as in the figures, when the first link 52 and the second link 53 are positioned at the middle position between the state of FIG. 9(*a*) and FIG. 9(*b*), the length $D_3$ of the elastic member 54 is the largest. That is, the elastic member 54 stretched a maximum length and the elastic restoring force is also maximum.

Rotation of the second link 53 is made easy or restricted by the operation of the elastic member 54, so it is possible to moved up and down the lifting drawer 30 or maintain the lifting drawer 30 in the moving-up or moving-down state.

Operation of the lifting drawer having this structure according to an embodiment of the present invention is described in detail hereafter with reference to the drawings.

Figure 10:
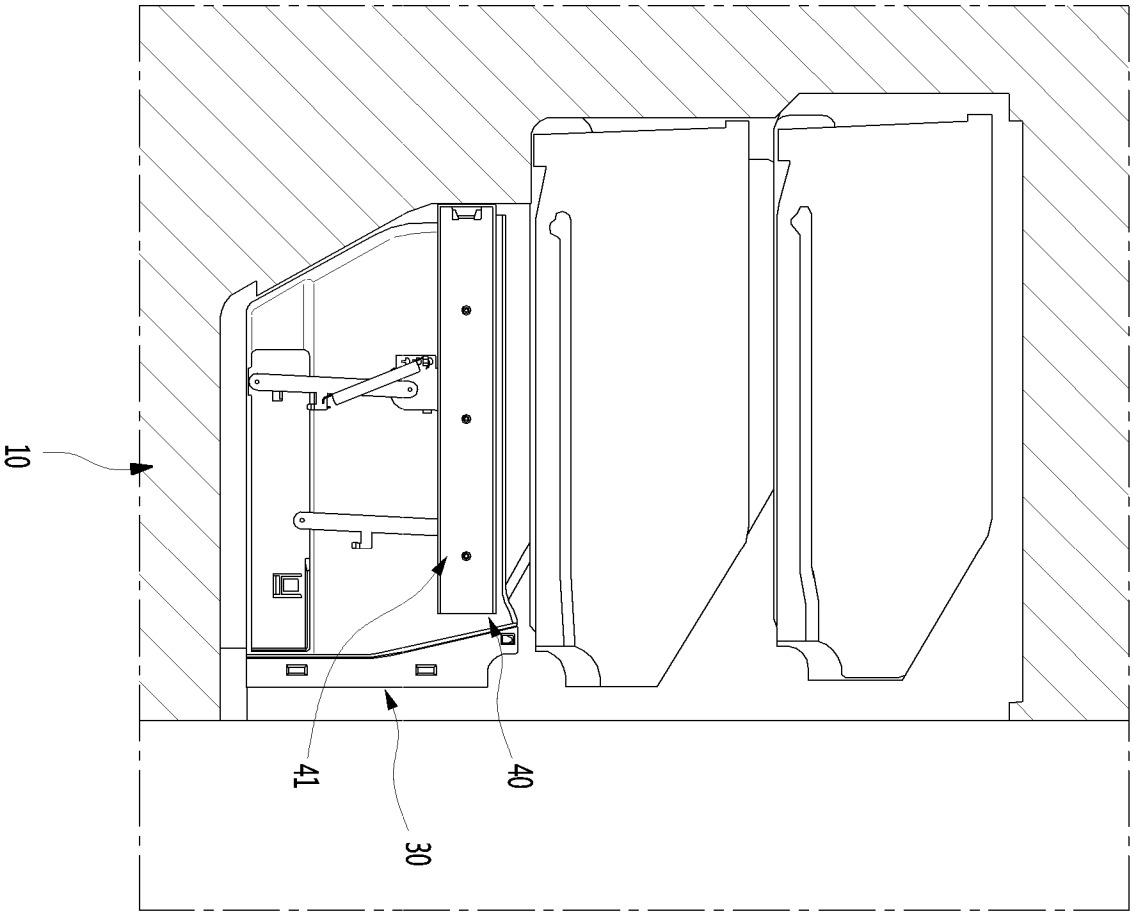
FIG. 10 is a view showing the lifting drawer drawn inside.
Figure 11:
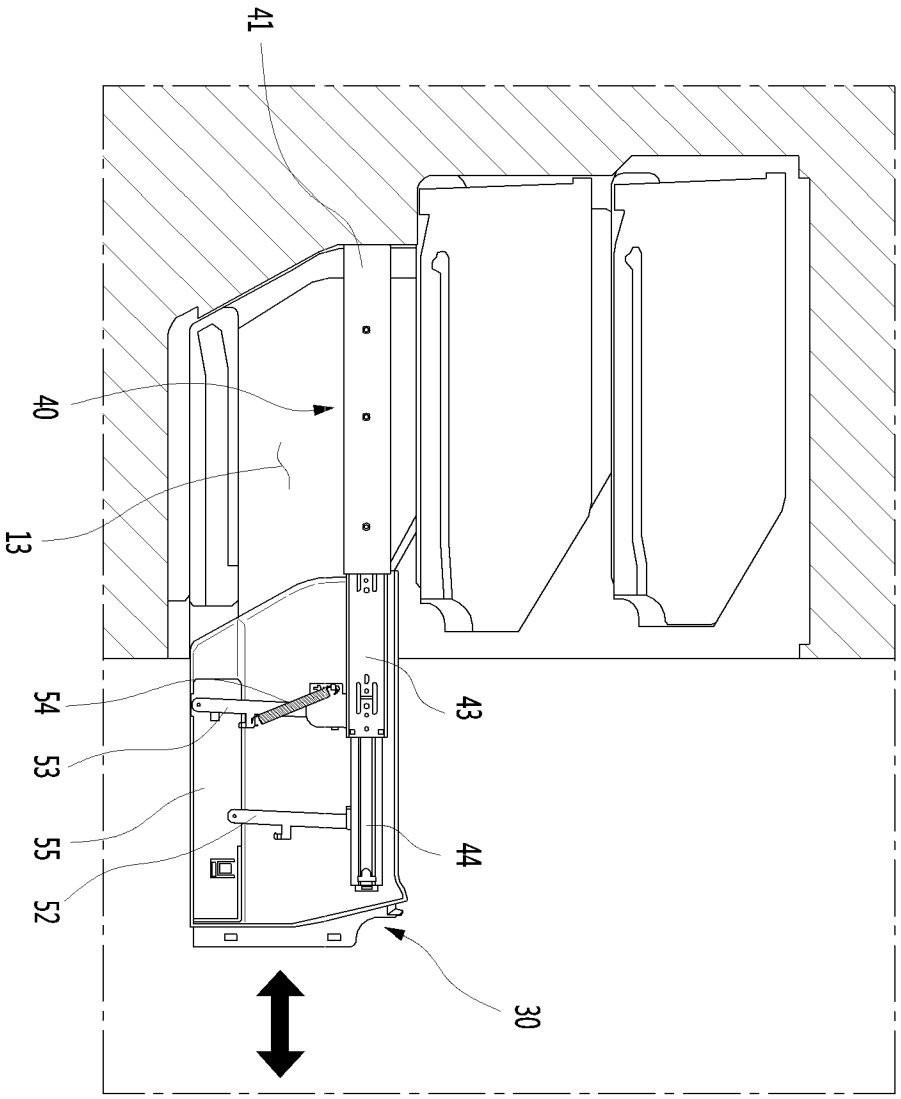
FIG. 11 is a view showing the lifting drawer drawn outside.
Figure 12:
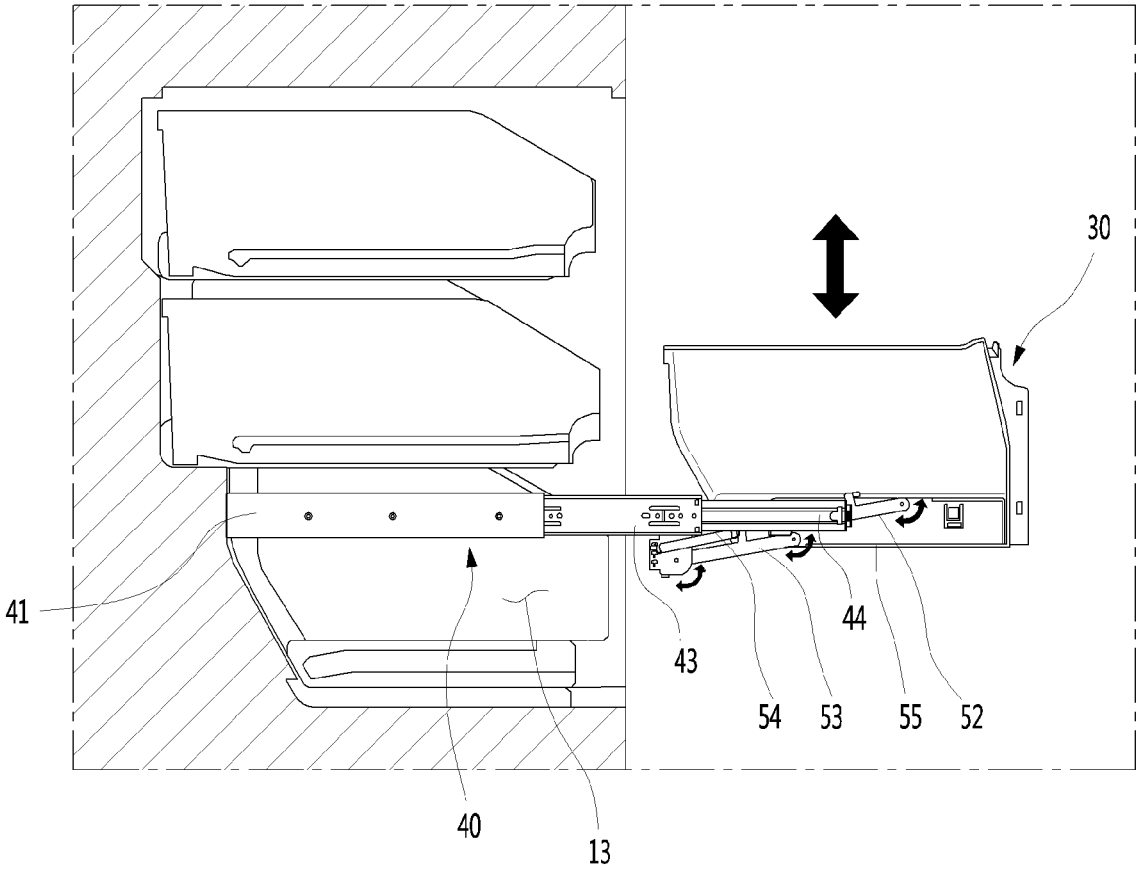
FIG. 12 is a view showing the lifting drawer lifted upward.
Figure 13:
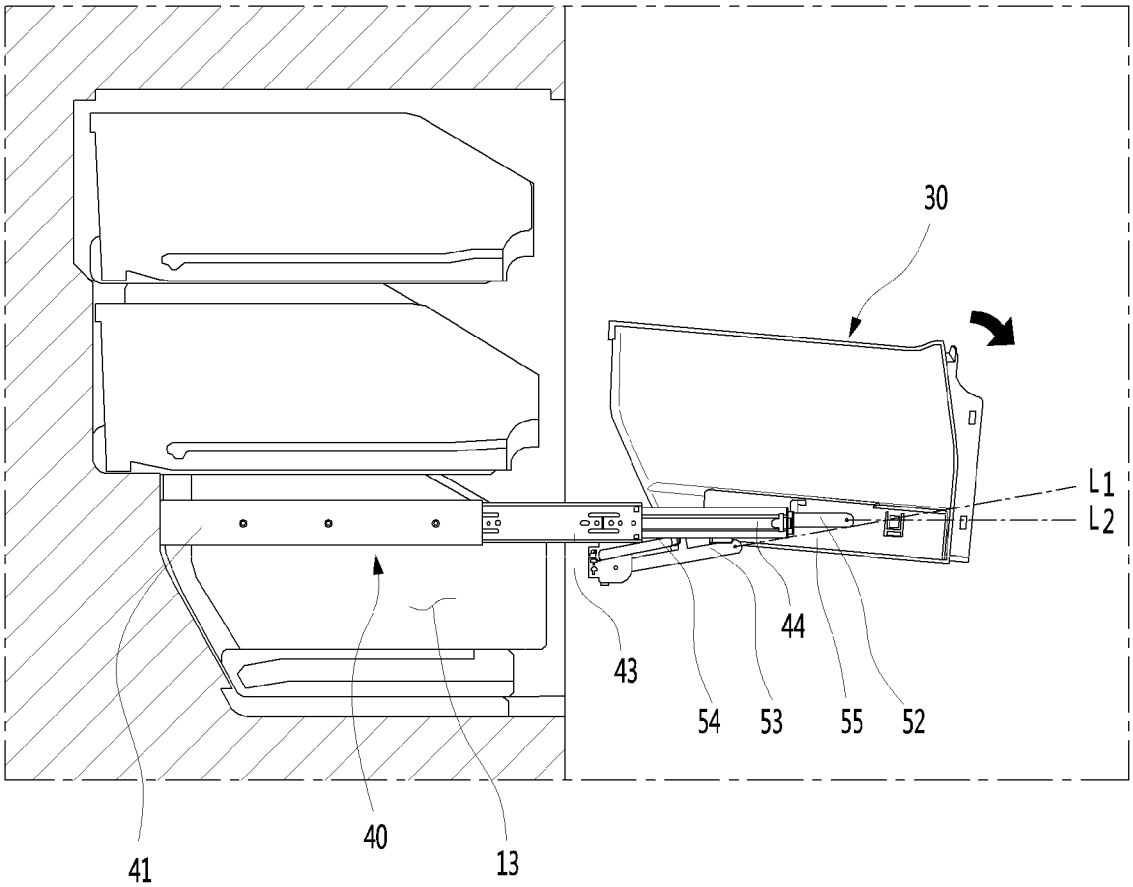
FIG. 13 is a view showing the lifting drawer in a locked state.

FIG. 10 is a view showing the lifting drawer drawn inside. FIG. 11 is a view showing the lifting drawer drawn outside. FIG. 12 is a view showing the lifting drawer lifted upward. FIG. 13 is a view showing the lifting drawer in a locked state.

As shown in the figures, a plurality of drawers may be vertically arranged in the freezer compartment 13 and has a structure that can be slid out. In particular, the lifting drawer 30 at the lowest position of the drawers can be slid in and out by the rail assemblies 40 and can be moved up and down by the lifting assemblies 50.

As shown in FIG. 10, the lifting drawer 30 can be fully drawn the refrigerator. When the lifting drawer 30 is drawn inside, the rail assemblies 40 are also fully drawn inside, thereby having the smallest length. In this state, the first link 52 and the second link 53 extend downward and the elastic member 54 is not stretched with the smallest length.

In this state, as in FIG. 11, a user holds the grip 321 of the lifting drawer 30 and pulls forward the lifting drawer 30, thereby drawing out the lifting drawer. As the lifting drawer 30 is drawn out, the rail assemblies 40 are stretched. The second rail 43 and the third rail 44 are fully drawn out, so the rail assemblies 40 can be drawn out of the refrigerator at a predetermined distance where they are not interfered with the other drawers.

The lifting assemblies 50 are not operated before the user moves up and down the lifting drawer 30 even after the lifting drawer 30 is fully drawn out, the first link 52 and the second link 53 are maintained in the downward-extending state without rotating, as in FIGS. 10 and 9(*a*), and the elastic member 54 is not stretched.

That is, the elastic member 54 should be stretched and the first link 52 and the second link 53 should be rotated to moving up and down the lifting drawer 30, and the force that is applied to slide in and out the lifting drawer 30 is smaller than the force for stretching the elastic member 54, so the lifting drawer 30 is not unexpectedly moved up and down.

When the lifting drawer 30 is drawn out and the rail assemblies 40 are fully stretched, the lifting drawer 30 is not drawn out any more, so the user can move up the lifting drawer 30 while pulling forward the grip 321.

When the lifting drawer 30 is pulled with the rail assemblies fully stretched such that the lifting drawer 30 is not drawn out any more, as in FIG. 12, moment is generated at the first link 52 and the second link 53, so the links are rotated counterclockwise. Until the first link 52 and the second link 53 reach a predetermined angle by rotating counterclockwise first, force larger than the stretching force of the elastic member 54 should be applied to stretch the elastic member 54 when the lifting drawer is lifted.

The first link 52 and the second link 53 are rotated at a predetermined angle and the elastic member 54 is maximally stretched, as in FIG. 9(*c*), and the user has to apply force while lifting the lifting drawer 30 till this state. In this state, when the user lifts the lifting drawer 30 and the first link 52 and the second link 53 are correspondingly further rotated counterclockwise, the elastic member 54 elastically restores. Accordingly, even though the user does not apply larger force, the first link 52 and the second link 53 are naturally rotated by the restoring force of the elastic member 54 and the lifting drawer 30 can be moved up.

When the first link 52 and the second link 53 finishes being rotated, the third stopper 513*c* restricts more rotation of the second link 53 by coming in contact with the second link 53, and the fourth stopper 532 further restricts rotation of the second link 53 by coming in contact with the rail assemblies 40. Accordingly, the lifting drawer 30 finishes being moved up without rotating any more as in FIGS. 12 and 9(*b*).

When the lifting drawer 30 has been moved up, it has been moved up at a predetermined height and has also been drawn out forward, so the user can more easily put food into the lifting drawer.

When the lifting drawer 30 is fully moved up, the center of gravity of the lifting drawer is positioned at the front portion, so the lifting drawer 30 is rotated clockwise about the upper end of the second link 53.

That is, as in FIG. 13, when the lifting drawer 30 finishes being moved up, the upper end of the second link 53 is positioned at the lower end of the rear half portion f the lifting drawer 30. Accordingly, the lifting drawer 30 may be tilted clockwise about the upper end of the second link 53 by the user moving down the front end of the lifting drawer 30 or the weight of the lifting drawer 30 and the food in the lifting drawer 30.

By tilting of the lifting drawer 30, the front end of the first link 52 can also be rotated with the lifting drawer 30. The first link 52 is not in parallel with, but crosses the second link 53 by the rotation, an extension line $L_1$ of the first link 52 and an extension line $L_2$ of the second link 53 cross each other. In this state, even if load is applied to the lifting drawer 30, force is applied to the first link 52 and the second link 53 in different directions, so they cannot be rotated together. Accordingly, even if load is applied to the lifting drawer 30, the lifting drawer 30 is not moved down.

In order to move down the lifting drawer 30 after putting food therein, the user can tilts the front half portion of the lifting drawer 30 such that the first link 52 and the second link 53 become parallel with each other. In this state, when load larger than the elasticity of the elastic member 54 is applied to the lifting drawer 30, the first link 52 and the second link 53 can be rotated together clockwise, so the lifting drawer 30 can be naturally moved down.

The lifting drawer 30 can be moved down and drawn inside in the reverse order of the process described above, and the repeated process is not described.

INDUSTRIAL APPLICABILITY

The refrigerator according to an embodiment of the present invention has improved convenience and stability, so high industrial applicability is expected.

The invention claimed is:

1. A refrigerator comprising:

a cabinet having a storage space;

doors mounted on the cabinet and configured to open and close the storage space;

a plurality of drawers vertically arranged in the storage space;

a lifting drawer disposed under the plurality of drawers;

rail assemblies that are disposed at both sides of the lifting drawer and that allow the lifting drawer to slide into and out of the storage space; and lifting assemblies that are rotatably coupled to the rail assemblies and the lifting drawer and that are configured to rotate the lifting drawer upward and downward based on the rail assemblies being drawn out from the storage space, wherein each of the lifting assemblies includes:

a mounting plate fixed to one of the rail assemblies, a supporting member coupled to one of a left side and a right side of the lifting drawer, a first link that is located at a front portion of the lifting drawer, the first link having a first end rotatably connected to the mounting plate and a second end rotatably connected to the supporting member, a second link that is located at a rear portion of the lifting drawer, that extends in parallel to the first link, and that is disposed rearward of the first link, the second link having a first end rotatably connected to the mounting plate and a second end rotatably connected to the supporting member, and an elastic member that is configured to be stretched and provide elastic force to the second link based on rotation of the second link, the elastic member having a first end connected to the supporting member and a second end connected to the second link, wherein the first link and the second link have a same length and extend between the mounting plate and the supporting member, wherein the first link and the second link are configured to rotate in a first direction to raise the lifting drawer relative to a bottom surface of the cabinet, and wherein the first link is configured to, based on the lifting drawer being raised to a highest position, rotate in a second direction opposite to the first direction to tilt the lifting drawer with respect to the bottom surface of the cabinet, extension lines of the first link and the second link intersecting each other based on the lifting drawer being tilted with respect to the bottom surface of the cabinet.

2. The refrigerator of claim 1, wherein the front portion of the lifting drawer is configured to be lower than the rear portion of the lifting drawer based on the lifting drawer being tilted with respect to the bottom surface of the cabinet.

3. The refrigerator of claim 1, wherein the rail assemblies guide the lifting drawer that is drawn out to a position not interfering with a shelf disposed over the lifting drawer when the lifting drawer is rotated upward.

4. The refrigerator of claim 1, wherein the lifting assemblies rotate the lifting drawer in front of the drawers disposed over the lifting drawer when the lifting drawer is moved up.

5. The refrigerator of claim 2, wherein the second link is rotatably disposed behind a center of gravity of the lifting drawer such that a front end of the lifting drawer is tilted down after the lifting drawer is moved up.

6. The refrigerator of claim 2, wherein supporting member mounting portions are recessed inward at lower ends of both sides of the lifting drawer to accommodate the supporting members.

7. The refrigerator of claim 6, wherein a seating portion protruding outward is formed on the supporting member mounting portion and a supporting portion supporting and retaining the seating portion is formed on the supporting member.

8. The refrigerator of claim 2, wherein the first link can be rotated at a position higher than the second link.

9. The refrigerator of claim 2, wherein the mounting plate has:

a first link connecting portion to which an upper end of the first link is rotatably coupled; and a second link connecting portion that extends downward further than the first link connecting portion at a side spaced part from the first link connecting portion and to which the upper end of the second link is rotatably coupled.

10. The refrigerator of claim 9, further comprising a first stopper and a second stopper that are disposed at the first link connecting portion and the second link connecting portion and that are configured to restrict rotation of the first link and the second link by coming in contact with outer sides of the first link and the second link based on the lifting drawer being positioned at a lowest position.

11. The refrigerator of claim 10, wherein a third stopper that restricts rotation of the second link by coming in contact with an outer side of the second link when the lifting drawer is positioned at the highest position is formed at the second link connecting portion.

12. The refrigerator of claim 10, wherein an elastic member fixing portion fixing a lower end of the elastic member and a third stopper extending from the elastic member fixing portion and restraining rotation of the second link by coming in contact with a lower end of the rail assembly when the lifting drawer is positioned at the highest position are formed at the second link.

13. The refrigerator of claim 12, wherein the mounting plate comprises elastic member mounting portions that are configured to fix an upper end of the elastic member and that are rearward and upward relative to a rotary shaft of the second link.

14. The refrigerator of claim 12, wherein the elastic member is configured to have a shorted length based on the second link coming in contact with the second stopper and the third stopper, and to have a longest length based on the second link being rotated to a middle point between the second stopper and the third stopper.

15. The refrigerator of claim 13, wherein the elastic member mounting portions are spaced apart from each other in a vertical direction, and wherein the upper end of the elastic member is configured to couple to one of the elastic member mounting portions to adjust elastic force by changing a coupling position of the upper end of the elastic member to the one of the elastic member mounting portions.

16. The refrigerator of claim 1, wherein the lifting drawer is configured to be drawn out from the storage space and raised to the highest position in a state in which a bottom surface of the lifter drawer is parallel to the bottom surface of the cabinet.

17. The refrigerator of claim 1, wherein the first link and the second link extend straightly between the mounting plate and the supporting member.

* * * * *